US005358348A

United States Patent [19]

Kennedy

[11] Patent Number: 5,358,348

[45] Date of Patent: Oct. 25, 1994

[54] WRITING IMPLEMENT AND HOLDER ASSEMBLY

[76] Inventor: Guy W. Kennedy, 7 Cedar Close, Epsom, Surrey K517 4HG, England

[21] Appl. No.: 14,189

[22] Filed: Feb. 3, 1993

[30] Foreign Application Priority Data

Feb. 3, 1992 [GB] United Kingdom ..... 9202218.5

[51] Int. Cl.[5] ..... B43K 29/20; B43K 31/00

[52] U.S. Cl. ..... 401/131; 211/69.1; 242/385.1; 401/99; 401/195; 401/52

[58] Field of Search ..... 401/99, 195, 131, 52; 24/3 M; 211/69.1; 224/162; 248/579; 242/107.6, 107.7

[56] References Cited

U.S. PATENT DOCUMENTS

| | | | |
|---|---|---|---|
| 245,257 | 8/1881 | Wright | 242/107.7 |
| 264,593 | 9/1882 | Wright | 242/107.7 |
| 1,511,167 | 10/1924 | Jesnig | 211/69.1 |
| 1,576,965 | 3/1926 | Giese | 242/107.7 |
| 2,027,857 | 1/1936 | Buehner | 211/69.1 |
| 2,696,695 | 12/1954 | Decker | 242/107.6 X |
| 2,759,685 | 8/1956 | Flippen | 242/107.6 |
| 2,793,617 | 5/1957 | Palmer | 401/99 X |
| 3,570,284 | 3/1971 | Hendricks | 401/195 M |
| 4,884,730 | 12/1989 | Carpenter | 224/162 |
| 4,958,952 | 9/1990 | Willett | 401/195 M |

FOREIGN PATENT DOCUMENTS

| | | | |
|---|---|---|---|
| 1358609 | 3/1964 | France | 211/69.1 |

*Primary Examiner*—Steven A. Bratlie
*Attorney, Agent, or Firm*—McCormick, Paulding & Huber

[57] ABSTRACT

A writing implement and holder assembly 10 has a pen 16 connected to a holder 12 by a retracting means, comprising a tie 14 attached to a spring loaded retracting unit 13, for drawing the pen 16 back towards a seat channel 20 in the holder 12 when the pen 16 is not in use. The holder 12 has guide surfaces 22, 24, 41, 42, 43, 44, 45, 46 and 47 to deflect and orientate the pen 16 as it abuts these guide surfaces under the retractive force for the pen 16 to be automatically received in the seat 20 of the holder 12.

7 Claims, 3 Drawing Sheets

WRITING IMPLEMENT AND HOLDER ASSEMBLY

The present invention relates to an apparatus in the form of a pen (or other writing implement) and holder set. It is primarily concerned with such sets in which the pen, when not in use, is accommodated in a seat in the holder to which the pen is attached by a flexible tie, such as a chain, cord or filament, its unauthorized removal.

Pen and holder sets are known which have a seat in the holder in which the pen may be lain or inserted for ease of locating it when required, and have a flexible tie which connects between the pen and the holder to alleviate the pen from being removed, inadvertently or otherwise, from an area of use in which the pen holder was securely located. Although able to alleviate loss of a pen, this known arrangement had the disadvantage that the pen was seldom returned to its seating in the holder and was often left hanging from the flexible tie or untidily strewn across the writing area, when not in use.

An object of this invention is to provide a writing implement and holder set, where the writing implement and holder are connected to each other by a flexible tie and which set alleviates the above mentioned disadvantages of known sets.

According to the present invention there is provided a writing implement and holder assembly in which the writing implement is connected to the holder by a retracting means for drawing the writing implement back towards and into a seat in the holder when said pen is not in use.

The writing implement will usually be in the form of a pen, preferably a ball point pen, and for convenience will hereinafter be referred to as a pen, although it will be appreciated that other forms of writing implement may be utilized, such as a pencil.

The retracting means connecting the pen to the holder may comprise a flexible tie, such as a cord, chain or filament, and a retracting unit connected to one end of the tie to bias the tie to retract towards the retracting unit (with the retracting unit providing a constant retractive force on the tie). The retracting unit is preferably incorporated in the holder. Alternatively, the retracting unit may be incorporated as part of the pen.

Preferably, the pen (or other writing implement considered) is of elongated form which is conventional for pen and pencil structures.

The retracting means is preferably attached to extend substantially between the mid-length region of the pen and the seat of the holder.

The holder preferably comprises guide surfaces which are disposed and profiled relative to the seat in the holder so that when the retractive force applied by the retracting means draws the pen against the guide surfaces the reaction causes the pen to deflect and orientate itself as appropriate for the pen to be received in the seat in the holder. Desirably the guide surfaces are disposed to direct the pen to be accommodated in the seat when the pen is released, remote from the seat, from any direction, or when the pen is at any orientation, relative to the seat.

Preferably, the seat of the holder comprises a generally elongated channel within which the pen is longitudinally received, supporting it neatly and unobtrusively within the holder. Such an elongated seat channel for the pen may have two diverging faces, which serve as part of the guide surfaces to deflect the pen to a required seating position along the length of the seat under the retractive force applied thereto by the retracting means. These two diverging faces preferably support the pen at longitudinally spaced positions and create a void behind the mid-length region of the pen, when the pen is situated in the seat, the void facilitating manual finger access to grip the pen for use.

A preferred embodiment of a pen and holder set constructed in accordance with the present invention will now be described, by way of reference only, with reference to the accompanying illustrative drawings in which.

Figure 2:
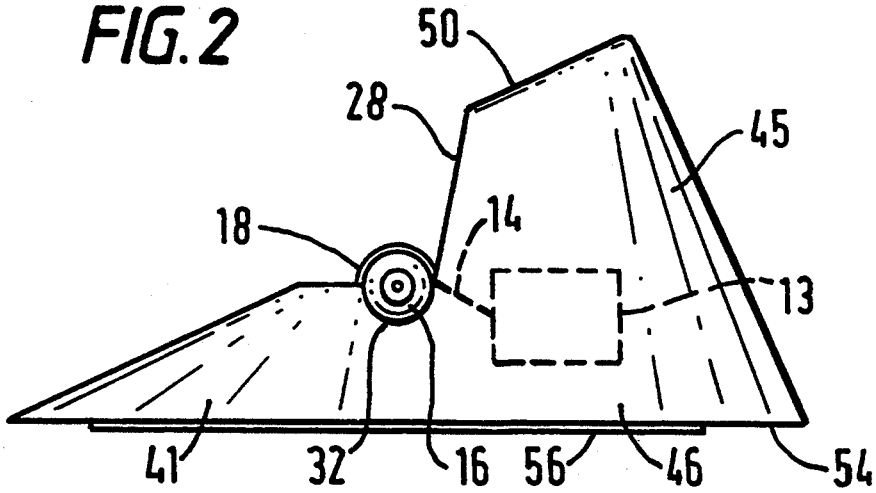
FIG. 2 is a side elevation of the set in FIG. 1.
Figure 3:
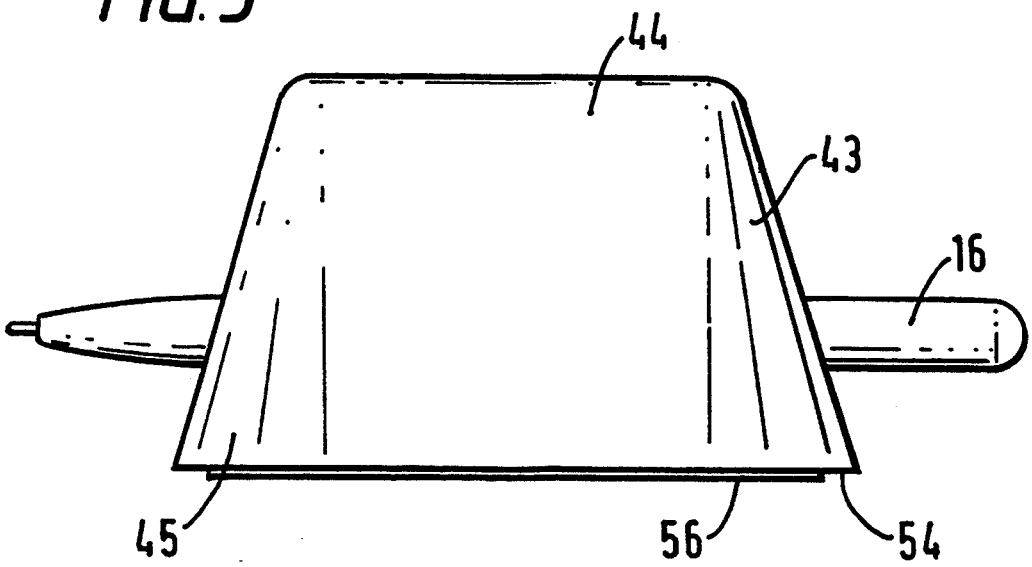
FIG. 3 is the rear elevation of the set in FIG. 1.
Figure 5:
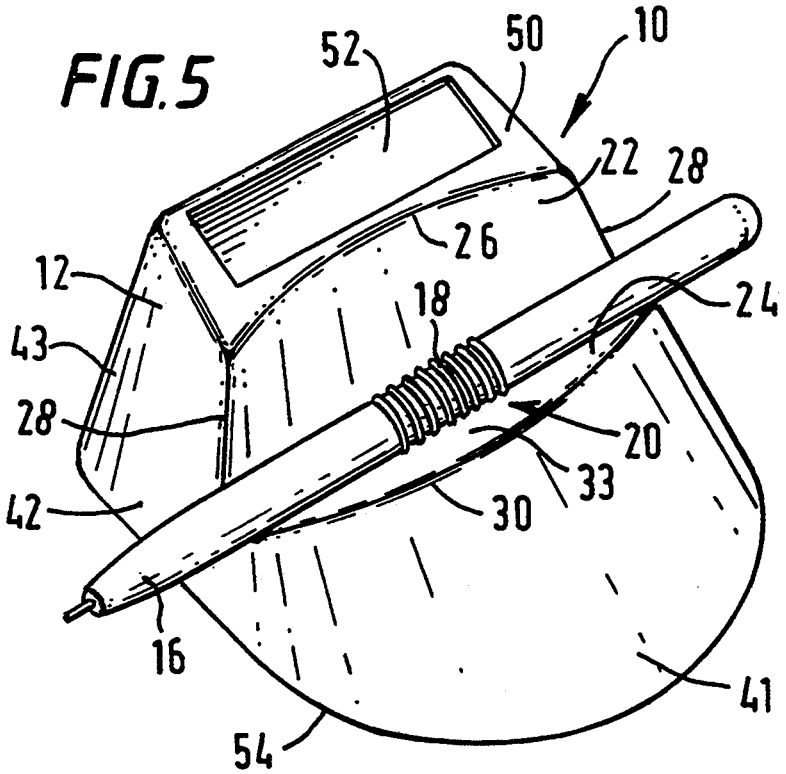
FIG. 5 is a perspective view of the set in FIG. 1 with the pen reversed.

The pen and holder assembly 10 comprises a plastics moulded holder 12 having a substantially flat horizontal base 54 on which it stands and contains a retracting unit shown generally at 13 in FIG. 2; a flexible tie in the form of a cord or plastics line 14 (FIG. 5) connects the retracting unit 13, through a hole 15 in the holder 12, to a conventional pen 16 of elongated form. The cord 14 is attached to the mid length region of the pen 16 by a collar 18 fitted on the pen 16. The retracting unit 13 is in the form of a spring loaded spool on which the cord 14 is wound so that the spool rotates against its spring loading as the cord 14 is drawn, under a traction force, from the spool, the biassing of the spool causing the cord to be rewound on the spool when the traction force is released. Such a simple form of retracting unit is well known.

Figure 4:
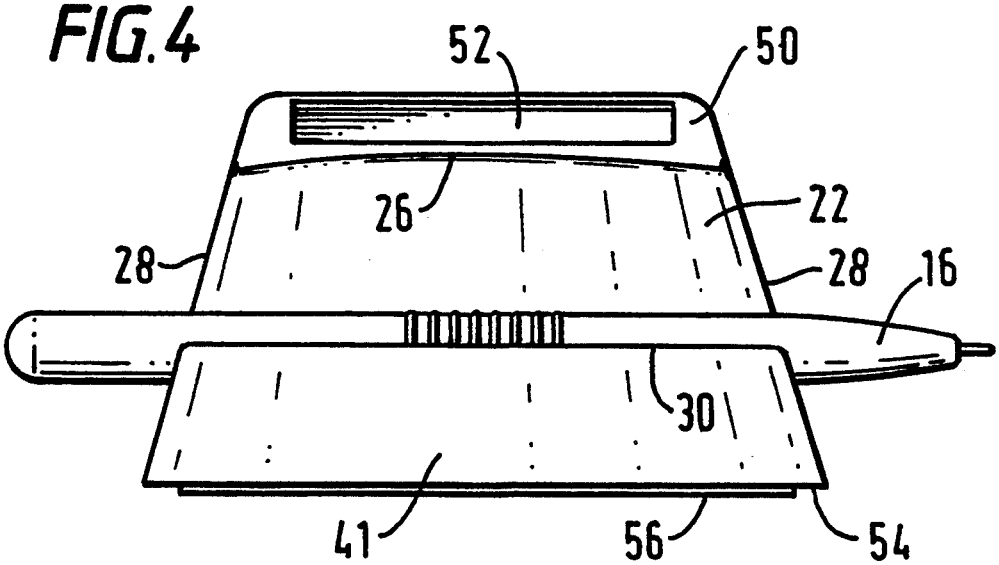
FIG. 4 is the front elevation of the set in FIG. 1.

In FIGS. 1 to 5 the pen 16 is shown situated in the seat 20 of the holder 12. The seat 20 is formed of a longitudinally extending channel presented by two diverging rear and front guide surfaces 22 and 24 which are seen more clearly in FIG. 6. The rear guide surface 22 tends upwardly and is concave, being generally part cylindrical, and has an upper edge 26 curving slightly upwards, as seen in FIG. 4. Upstanding side edges 28 of this surface 22 diverge outwardly from each other from the upper edge 26, as seen in FIG. 4.

Figure 6:
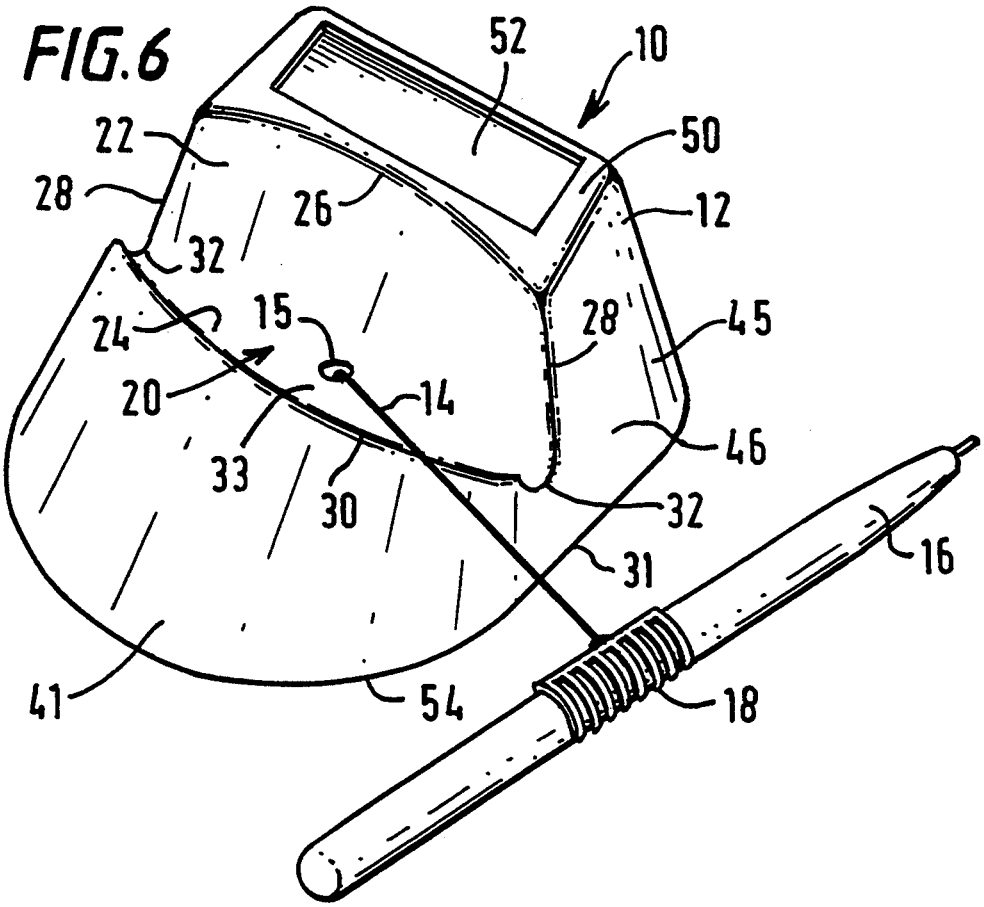
FIG. 6 is a perspective view of the set with the pen removed from its seat in the holder.

As will be seen from FIG. 6 the hole 15 is located substantially centrally at or towards the bottom of the elongated seat channel 20.

Figure 1:
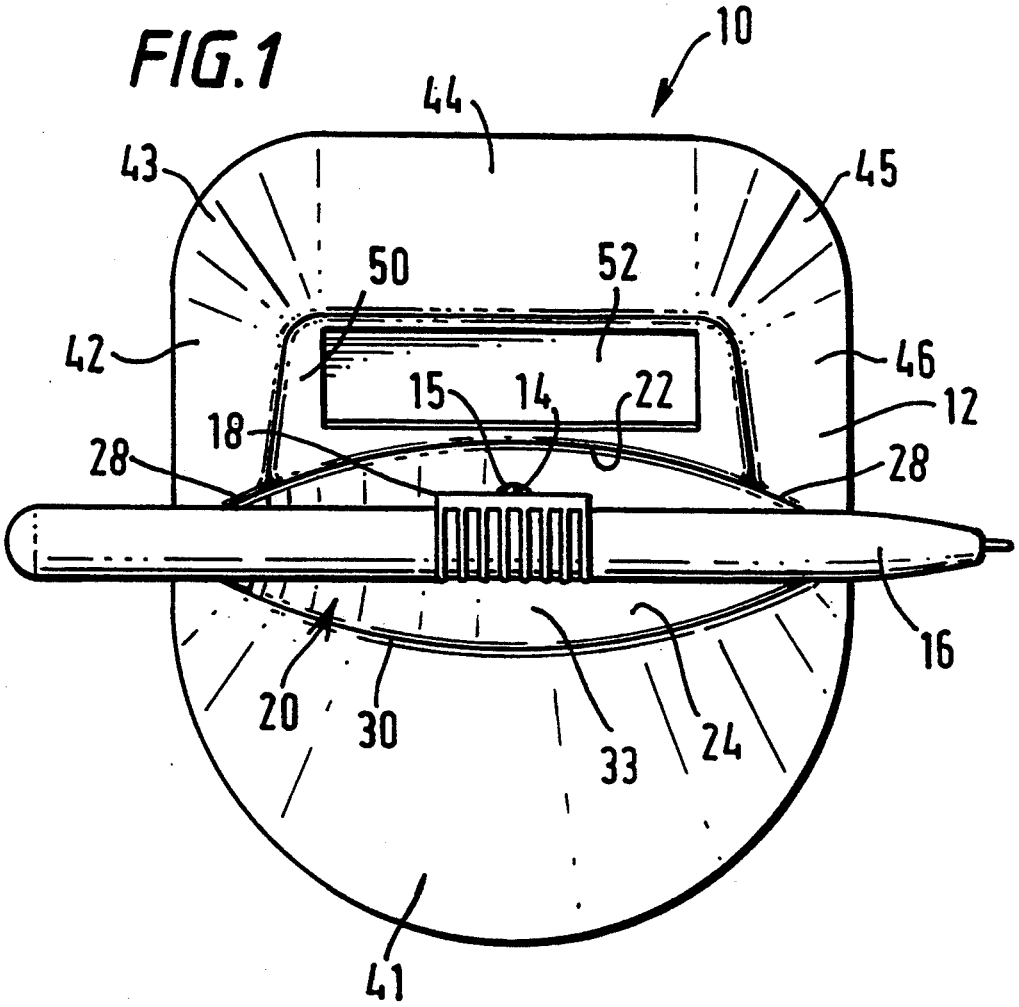
FIG. 1 is a plan view of the set with the pen the seat in the holder.

The front guide surface 24 of the seat 20 extends upwardly to a lesser extent than rear surface 22 and comprises a longitudinal concave surface of a generally ovaloid profile (which may be likened to the complementary profile of a conventional rugby ball). A front edge 30 of the guide surface 24 is curved in a horizontal plane as seen in FIGS. 1 and 4. Side edges 32 of the guide surface 24 merge into the side edges 28 of guide surface 22 (FIG. 6) to form two longitudinally spaced and opposed supports for the pen 16 within the seat 20 of the holder 12.

The holder 12 has further peripheral guide surfaces disposed about the seat 20 and these include a front, part spherical surface 41, opposed side surfaces 42 and 46, a rear surface 44 and two rear corner transition surfaces 43 and 45. All these guide surfaces are splayed outwardly to diverge from each other as they approach the base 54 of the holder 12 and merge about the periphery of the holder 12 to present a continuous smooth profile, FIG. 5. A top surface 50 of the holder 12 comprises a flat name plate 52 which tapers down inwardly to join the surrounding peripheral guide surfaces 42, 43, 44, 45 and 46 and the upper edge 26 of the guide surface 22. The top surface 50 slopes generally downwardly towards the seat channel 20 as seen in FIG. 2.

The base 54 of the holder 12 may carry an adhesive pad 56 by which the holder can be firmly secured to a flat surface.

In use the pen holder 12 may be placed on a flat writing surface, such as a desk, where the adhesive pad 56 can hold it firmly. The pen 16 will sit in the seat 20, resting on the longitudinally spaced and opposed edge supports 32, and held in place by the biassed cord 14. The seat channel 20 formed by the guide surfaces 22 and 24 supports the pen 16 at the longitudinally spaced edge supports 32; the central portion 33 of the seat channel 20, being concave, thus forms a void or gap between the holder and the mid section of the pen 16. This gap permits fingers of a user to move behind the pen 16 to obtain a firm grip and pick up the pen 16.

The pen 16 may then be pulled away from the holder 12, a slight force required to overcome the permanent retractive force exerted on the cord 14 by the retracting unit. When the pen 16, remote from the holder, is released by the user the retractive force exerted on the cord 14 pulls the pen 16 back towards the holder 12. The connection of the cord 14 to the mid section of the pen 16 ensures that the retractive force is evenly distributed along the length of the pen 16. As the pen 16 is pulled against holder 12 it abuts one or more of the guide surfaces 22, 24, 41, 42, 43, 44, 45, 46 or 50. This abutment automatically deflects the pen 16 towards and into the seat channel 20 to accommodate the pen in the seat channel 20, as shown in either FIG. 1 or FIG. 5, irrespective of the position from which the pen 16 is released or the orientation of the pen 16, relative to the seat 20, when it is released.

It will be appreciated that the embodiment of the invention herein described may be varied to suit particular requirements. Such variations would include replacing a pen with a different writing implement or using different methods to attach the holder to a writing surface (such as adding a flange to the base of the holder through which retaining bolts may pass) and attaching the pen holder to a vertical surface such as a wall. Variations to the design of the guide surfaces could also be varied to suit different writing implements and requirements, provided were able to deflect the writing implement back to the seat irrespective to the position of release of the writing implement.

However, it should also be considered that when the pen is released to be pulled into abutment with the holder by the cord it is possible for any part of the pen over its longitudinal extent to initially abut a guide surface of the holder; consequently one end of the pen which includes a writing tip can initially abut the guide surfaces causing the pen to reorientate itself as necessary to be drawn into the seat channel to be neatly presented with the holder. Because of the possibility for the writing tip of the pen to impact the holder it is preferred that the writing tip is in the form of a robust ball point which is unlikely to be damaged by such impact.

It should also be appreciated that the retracting unit could alternatively be incorporated in the pen, with the cord connecting the retracting unit to the central portion of the seat in the holder, the retracting force exerted by the retracting unit still biasing the cord towards the retracting unit but, due to the holder being fixed and thus immovable, the pen would still be drawn towards the holder on its release.

I claim:

1. A writing implement and holder assembly comprising an elongated writing implement having a mid-portion of said writing implement provided generally midway between the opposed ends of said elongated writing implement, a retracting cord having one end secured to said mid-portion, a holder having top, bottom and front surfaces, said top and front surfaces defining an elongated ovaloid concave cavity with truncated opposite end portions defining edge supports for said writing implement, said cavity having a central opening for receiving said cord, and means for retracting said cord provided inside said housing so as to normally bias said writing implement into a position where said implement is supported by said edge supports in a position where the implement can be readily grasped at its mid-portion by the user as a result of the concave ovaloid shaped cavity provided for this purpose in the holder.

2. The writing implement and holder assembly of claim 1 wherein said holder front surface (41) is of convexly curved contour and serves to guide the elongated writing implement toward the said cavity by reason of said convexly curved contour, said front guide surface of said holder also being sloped for the same reason.

3. The writing implement and holder assembly of claim 2 wherein said top surface (50) is provided above said curved front surface (41) and wherein said top and front surfaces cooperate with said cavity to define arcuate edges (24 and 26 respectively) that serve to guide the writing implement into said cavity when released by the user.

4. The writing implement and holder assembly of claim 3 wherein said holder top surface (50) includes a recessed name plate area (52).

5. The writing implement and holder assembly according to claim 4 wherein said cavity edge (26) defined in part by said top surface is provided in vertically spaced relationship above the edge (30) of said cavity defined in part by said front curved surface, said front curved surface also being sloped upwardly to guide the writing implement into said cavity.

6. The writing implement and holder assembly according to claim 5 wherein said writing implement has a collar provided at its mid-portion, and wherein said retracting cord has one end secured to said collar.

7. The writing implement and holder assembly according to claim 3 wherein said front surfaces of convexly curved contour act as guide surface for the implement, and wherein said holder has side surfaces 42 and 46 also convexly contoured, and wherein said holder has corners 43 and 45 that cooperate with these convexly contoured front and side surfaces so that when the retractive force applied by the retracting cord draws the writing implement against the guide surfaces the reaction causes the writing implement to deflect and orientate itself as appropriate for the writing implement to be received automatically in the seat in the holder, irrespective of the direction of release of the writing implement when remote from the seat or the orientation of the writing implement relative to the seat.

* * * * *